US012551000B2

(12) United States Patent
Andersen et al.

(10) Patent No.: US 12,551,000 B2
(45) Date of Patent: Feb. 17, 2026

(54) CARRYING DEVICE FOR CARRYING AN ELONGATED OBJECT

(71) Applicant: Vorn Equipment AS, Stavanger (NO)

(72) Inventors: Eirik Andersen, Stavanger (NO); Stig Strømsnes, Drammen (NO)

(73) Assignee: Vorn Equipment AS, Stavanger (NO)

( * ) Notice: Subject to any disclaimer, the term of this patent is extended or adjusted under 35 U.S.C. 154(b) by 94 days.

(21) Appl. No.: 18/832,223

(22) PCT Filed: Jan. 24, 2023

(86) PCT No.: PCT/NO2023/050019

§ 371 (c)(1),
(2) Date: Jul. 23, 2024

(87) PCT Pub. No.: WO2023/146412

PCT Pub. Date: Aug. 3, 2023

(65) Prior Publication Data

US 2025/0228352 A1 Jul. 17, 2025

(30) Foreign Application Priority Data

Jan. 26, 2022 (NO) ..... 20220123

(51) Int. Cl.
*A45F 3/08* (2006.01)
*A45F 3/00* (2006.01)
*A45F 3/06* (2006.01)

(52) U.S. Cl.
CPC ..... *A45F 3/08* (2013.01); *A45F 3/06* (2013.01); *A45F 2003/003* (2013.01)

(58) Field of Classification Search
CPC ..... A45F 3/06; A45F 3/08; A45F 3/10; A45F 2003/003
See application file for complete search history.

(56) References Cited

U.S. PATENT DOCUMENTS 3,889,859 A * 6/1975 Joseph ..... A45F 3/08 224/636
4,074,839 A 2/1978 Wood
(Continued)

FOREIGN PATENT DOCUMENTS

| | | | |
|---|---|---|---|
| DE | 102012017793 | A1 | 3/2014 |
| EP | 2801283 | A1 | 11/2014 |
| WO | 2011068414 | A1 | 6/2011 |

OTHER PUBLICATIONS

Search Report for Corresponding Norwegian Application No. 20220123, dated Sep. 1, 2022.

(Continued)

*Primary Examiner* — Justin M Larson
(74) *Attorney, Agent, or Firm* — ANDRUS INTELLECTUAL PROPERTY LAW, LLP

(57) ABSTRACT

A carrying device for an elongated object has a rucksack bag, a rucksack frame, a carrying system connected to the rucksack frame, and a carrying pocket at one side of the rucksack bag, openable to an lateral exterior of the rucksack bag and arranged to receive at least a portion of the elongated object to be carried. A rucksack frame is integrated in the rucksack bag, and has a first, upper transverse connecting member, and a first transverse frame extension element accommodated inside the rucksack bag and connected to the upper connecting member at a distance therefrom, forming at one lateral side of the rucksack bag a U-shaped upper support for the carrying pocket. The upper support is open to one side of the carrying pocket, and the first transverse frame extension element is extending in opposing directions, forming an upper support extending over a full width of the rucksack bag.

13 Claims, 3 Drawing Sheets

(56) References Cited

U.S. PATENT DOCUMENTS

| | | | | |
|---|---|---|---|---|
| 5,016,794 | A * | 5/1991 | Beagle, Jr. | A45F 3/14 224/907 |
| 6,290,114 | B1 * | 9/2001 | Berberian | A45F 3/04 224/916 |
| 8,714,147 | B2 * | 5/2014 | Walk | F41B 5/066 224/916 |
| 9,074,840 | B2 * | 7/2015 | Andersen | F41C 33/06 |
| 10,251,467 | B2 * | 4/2019 | Donhauser | A45F 3/12 |
| 10,473,425 | B2 * | 11/2019 | Gorton | F41C 33/005 |
| 11,229,276 | B2 * | 1/2022 | Simione | B60P 7/0807 |
| 12,329,270 | B1 * | 6/2025 | Carpenter | F41B 5/063 |
| 2002/0170932 | A1 | 11/2002 | Higgins | |
| 2005/0000995 | A1 | 1/2005 | Eberle | |
| 2006/0113341 | A1 * | 6/2006 | Murray | B60R 7/14 211/64 |
| 2006/0163304 | A1 | 7/2006 | Slesar | |
| 2007/0145091 | A1 | 6/2007 | Meesey | |
| 2007/0145092 | A1 | 6/2007 | Eberle | |
| 2010/0176172 | A1 | 7/2010 | Gleason, Jr. | |
| 2012/0292353 | A1 | 11/2012 | Andersen | |
| 2021/0145137 | A1 | 5/2021 | Williams | |
| 2023/0087253 | A1 * | 3/2023 | Bender | A45F 3/06 224/650 |
| 2024/0292938 | A1 * | 9/2024 | Bender | A45F 3/06 |
| 2025/0228352 | A1 * | 7/2025 | Andersen | A45F 3/08 |

OTHER PUBLICATIONS

International Search Report for Corresponding International Application No. PCT/NO2023/050019, dated Apr. 25, 2023.

Supplementary European Search Report for EP 23747433, dated Nov. 28, 2025.

* cited by examiner

CARRYING DEVICE FOR CARRYING AN ELONGATED OBJECT

CROSS-REFERENCE TO RELATED APPLICATIONS

This application is the U.S. national stage application of International Application No. PCT/NO2023/050019, filed Jan. 24, 2023, which international application was published on Aug. 3, 2023, as WO 2023/146412 in the English language. The International Application claims priority to Norwegian patent application No. 20220123, filed Jan. 26, 2022. The international application and Norwegian application are both incorporated herein by reference, in their entirety.

FIELD

A carrying device for an elongated object is disclosed, the carrying device comprising a rucksack bag, a rucksack frame, and a carrying system connected to the rucksack frame. A carrying pocket is arranged laterally at one side of the rucksack bag. The carrying pocket is openable to a lateral exterior of the rucksack bag and arranged to receive at least a portion of the elongated object to be carried. The rucksack frame is integrated in the rucksack bag. The carrying pocket is defined by portions of the rucksack bag and portions of the rucksack frame.

BACKGROUND

There exist several devices for carrying elongated objects such as long-barrelled weapons, fishing rods, skateboards, snowboards, crossbows etc.

For military purposes, a primary weapon such as an automatic rifle is carried in the sol-dier's hands, while a secondary weapon, typically a sniper rifle, is carried on the back by means of a carrying device.

For hunting purposes, there is often a need to carry a rifle for a long distance and/or for long periods in rugged terrain before the hunter arrives in the habitat of the game. This is anatomically disadvantageous.

US 2007/0145091 describes a wearable holster for concealing a firearm on a user, comprising a quick release fastener. US 2006/0163304 describes a quick-release support strap device for carrying a weapon. None of these publications protect the weapon in a sufficient way. Moreover, they are cumbersome to use, nor do they allow the facile carrying of the weapons.

Commercially available rucksacks comprise a primary rucksack bag with shoulder straps similar to an ordinary backpack, further comprising a secondary bag for a long-barrelled weapon. Here, the weapon is carried with the weapon nozzle pointing downwards and the gunstock pointing upwards. When releasing the weapon, the user has to pull the weapon a substantial distance vertically up and then out from the secondary bag. This is a cumbersome operation which may take several seconds, which can be fatal in combat situations. To avoid this, the weapon must have some space in the secondary bag since it should be possible to pull it up and out. Consequently, the weapon is not fixed in relation to the pack, which may not be comfortable during long walks.

WO2011068414 A1 discloses an improved carrying device, the device comprising a first protective layer and a second protective layer, typically forming portions of a rucksack configuration, where the respective layers are joined together at least at some point to form a fold; at least one releasable locking device for locking at least a part of the first protective layer to at least a part of the second protective layer, thereby providing that the elongated object may be carried between the first and second protective layer. How-ever, a drawback of this device is the deformation of fabrics configuration due to the load of the elongated object(s) being transferred through the relative soft and unstable material forming the packing structure of a rucksack of this kind.

SUMMARY

The invention has for its object to remedy or to reduce at least one of the drawbacks of the prior art, or at least provide a useful alternative to prior art.

The object is achieved through features, which are specified in the description below and in the claims that follow.

An improved carrying device for an elongated object, e.g. a long-barrelled weapon, is provided, the carrying device comprising a rucksack bag wherein a rucksack frame is forming an integral part of the forward portion of the rucksack bag, forming anchoring points at least for straps connecting the rucksack bag via the rucksack frame to a carrying system of the carrying device. The rucksack frame comprises a first, upper, transverse connecting member. The first, upper, transverse connecting member extends over a full width of the rucksack bag. The first, upper, transverse connecting member may form anchoring points for adjustable straps connecting the rucksack bag via the rucksack frame to an upper portion of shoulder straps of the carrying system. A first transverse frame extension element is connected to the upper connecting member at a distance therefrom and accommodated inside the rucksack bag, forming at one side of the rucksack bag a stable U-shaped upper support for a carrying pocket, the upper support being open to one side of the rucksack bag.

In a preferred embodiment a second, lower transverse frame member is connected to the first, upper connecting member by one or more vertical members. A second transverse frame extension element is connected to the lower connecting member at a distance therefrom, being accommodated inside the rucksack bag and forming a stable U-shaped lower support for the carrying pocket, the lower support being open to the previously said side of the rucksack bag.

In a preferred embodiment the transverse frame extension elements are extending from protrusions in the respective connecting members.

The upper, first transverse frame extension element is preferably extending in opposing directions from said protrusion, forming upper support extending over the full width of the rucksack bag.

The lower, second transverse frame extension element is preferably extending to one side of said protrusion only.

The protrusion of the first, upper connecting member is preferably extending in a centre plane of the rucksack. The centre plane of the rucksack corresponds to the median plane/mid-sagittal plane of a user wearing the rucksack.

The protrusion of the second, lower connecting member is preferably extending off-set the centre plane of the rucksack, forming a deeper U-shaped support than that of the upper connecting member, thus providing sufficient space for a gunstock end portion.

The protrusions of the connecting members are preferably provided with openings facing the carrying system, arranged for access to transverse frame extension element fixing portions.

The second, lower transverse frame member is preferably provided with first anchoring points for one or more adjustable load transfer straps extending to an upper portion of the carrying system, arranged for transfer of load from the rucksack to the upper portion of the carrying system.

The rucksack frame is fully or partly accommodated in channels formed in the fabrics of the rucksack bag.

At least the first, upper connecting member may provide releasable clamp members arranged to secure one or more fabric flaps of the rucksack bag to the rucksack frame.

The integrated rucksack frame allow improved, adjustable load transfer from the rucksack bag to the upper portion of the carrying system by the load of the rucksack bag being ap-plied to the first transverse frame extension element and further onto the carrying system via the first, upper transverse connecting member to the second, lower transverse frame member and further via the adjustable strap(s) extending from the second, lower transverse frame member to a central portion of the carrying system.

The invention is defined by the independent patent claim. The dependent claims define advantageous embodiments of the invention.

More specifically, the invention relates to a carrying device for an elongated object, the carrying device comprising a rucksack bag, a rucksack frame, and a carrying system connected to the rucksack frame, and a carrying pocket arranged at one side of the rucksack bag, openable to a lateral exterior of the rucksack bag and arranged to receive at least a portion of the elongated object to be carried, wherein the rucksack frame is integrated in the rucksack bag, the rucksack frame comprising a first, upper transverse connecting member forming anchoring points for adjustable stabilizing straps connecting the rucksack frame to the carrying system; and a first transverse frame extension element accommodated inside the rucksack bag and connected to the upper connecting member at a distance therefrom, forming at one lateral side of the rucksack bag a U-shaped upper support for the carrying pocket, the upper support being open to one side of the carrying pocket, and the first transverse frame extension element is extending in opposing directions, forming an upper support extending over a full width of the rucksack bag.

An effect of this is that load is transferred from the rucksack bag to the carrying system via a rigid frame extending away from the carrying system, thus reducing the deformation of the bag fabrics.

The first, upper, transverse connecting member may extend over a full width of the rucksack bag.

The rucksack frame may comprise a second, lower transverse frame member connected to the first, upper connecting member by one or more vertical members, and a second transverse frame extension element is accommodated inside the rucksack bag and connected to the lower connecting member at a distance therefrom, forming a U-shaped lower support for the carrying pocket, the lower support being open to one side of the carrying pocket. An effect of this is that the lower portion of the carrying pocket is stabi-lized, causing additional load transfer to the rucksack frame.

The transverse frame extension elements may extend from protrusions in the respective connecting members. An effect of this is that the U-shaped upper and lower supports are provided with robust bottom portions.

The first transverse frame extension element may extend in opposing directions from a protrusion in the first, upper transverse connecting member.

The protrusion of the first, upper transverse connecting member may extend from the first, upper transverse connecting member along a centre plane of the rucksack bag. An effect of this is that the load transfer to the rucksack frame is equally distributed laterally.

The second transverse frame extension element may extend in one direction only from a protrusion in the second, lower transverse connecting member towards the carrying pocket. An effect of this is that the rucksack frame occupies less space inside the rucksack bag, providing more loading capacity.

The protrusion of the second, lower transverse connecting member may extend off-set a centre plane of the rucksack bag. An effect of this is that the cross section of the carrying pocket can be accurately adapted to the shape of the elongated object to be carried, e.g. providing enough space for a gunstock of a long-barrelled weapon.

Each protrusion may be provided with a countersunk opening facing the carrying system and arranged for insertion of fixing means in transverse frame extension element fixing portions. An effect of this is that the fixing means are sheltered.

The rucksack frame may comprise a second, lower transverse frame member forming a first anchoring point for an adjustable load transfer strap extending to the central portion of the carrying system, arranged for transfer of load from the rucksack bag to shoulder straps of the carrying system. An effect of this is that load is transferred directly from the rucksack frame to the shoulder straps in an adjustable way.

The first, upper transverse connecting member may form anchoring points for adjustable stabilizing straps between the rucksack bag and the carrying system.

The rucksack frame may be fully or partly accommodated in channels formed in fabrics of the rucksack bag. An effect of this is that assembly of the carrying device is eased.

The rucksack frame may be provided with one or more releasable clamp members arranged to secure one or more fabric flaps of the rucksack bag to the rucksack frame. An effect of this is that also portions of the rucksack frame not suitable for insertion into channels of the rucksack bag may be sheltered and thoroughly connected to the bag fabrics.

BRIEF DESCRIPTION OF THE DRAWINGS

In the following is described an example of a preferred embodiment illustrated in the ac-companying drawings, wherein.

DETAILED DESCRIPTION OF THE DRAWINGS

Figure 1:
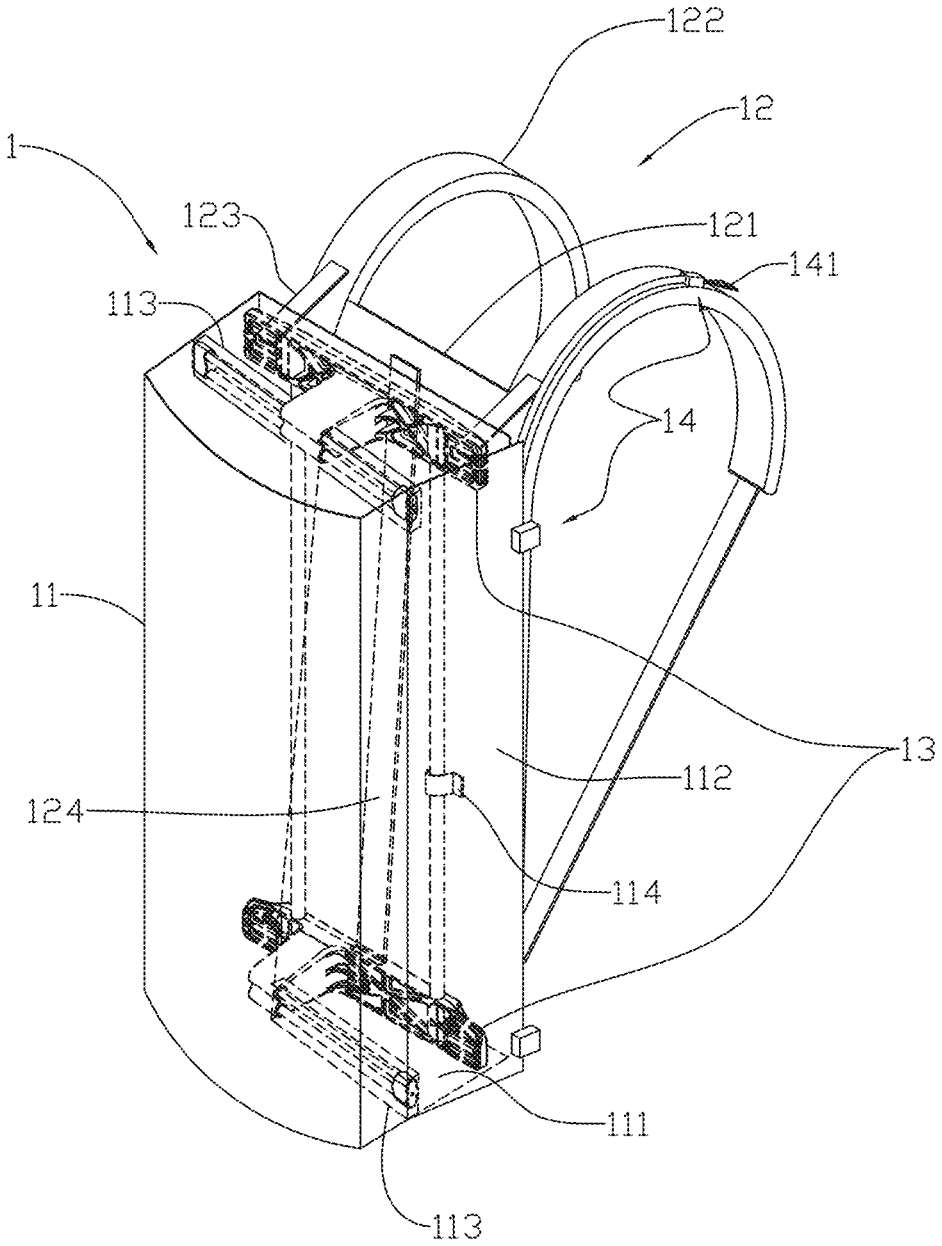
FIG. 1 shows a perspective view of a carrying device according to the invention.

Any positional indications refer to the position shown in the figures.

In the figures, same or corresponding elements are indicated by same reference numerals. For clarity reasons, some elements may in some of the figures be without reference numerals.

A person skilled in the art will understand that the figures are just principal drawings. The relative proportions of individual elements may also be distorted.

In FIG. 1 reference numeral 1 refers to a carrying device arranged for carrying an elongated object like a long-barrelled weapon. The carrying device 1 shown being a rucksack provided with a rucksack bag 11 made of fabrics, a carrying system 12 comprising various straps, and a rucksack frame 13 integrated in the rucksack bag 11. The rucksack bag 11 is provided with a laterally positioned carrying pocket 111 arranged to accommodate at least a portion of an elongated object (not shown) like a long-barrelled weapon, e.g. a gunstock of said weapon. Further details will be explained later. For the sake of clarity, the rucksack bag 11 is depicted without a lid.

Figure 2:
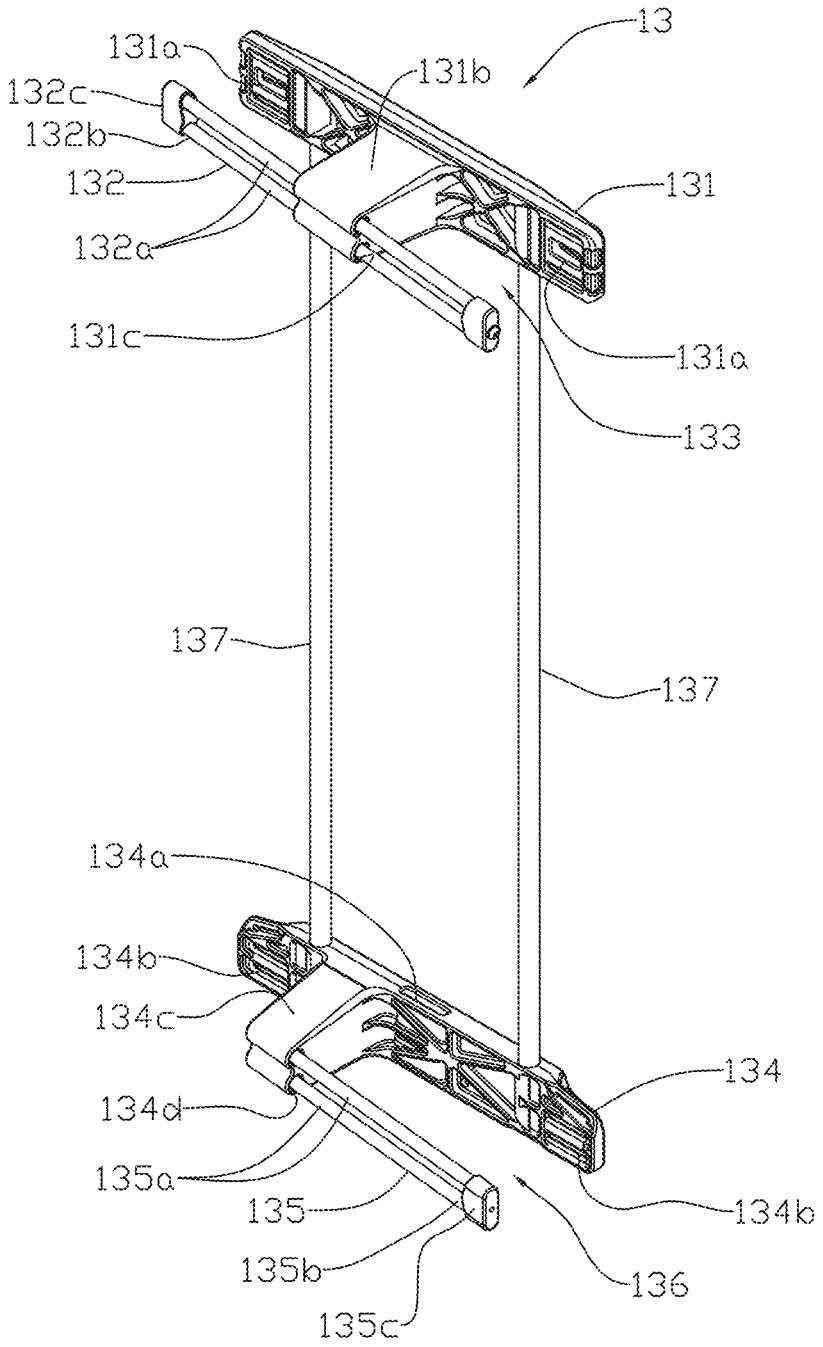
FIG. 2 shows in perspective view a rucksack frame arranged to be integrated in a rucksack bag.
Figure 3:
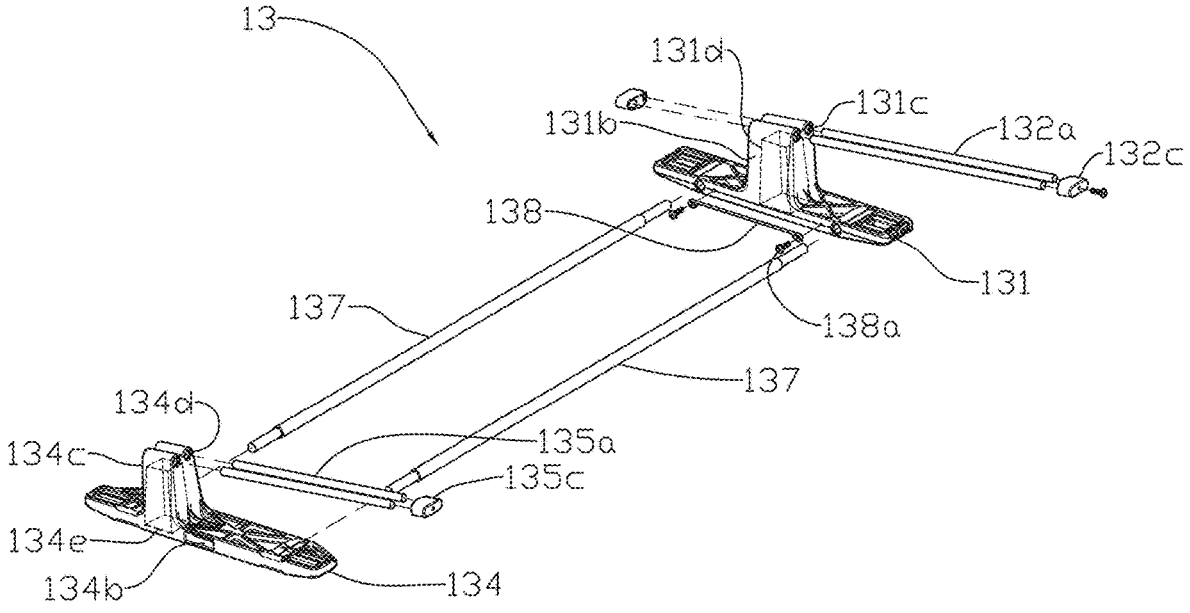
FIG. 3 shows an exploded view of the rucksack frame.

It is now referred to FIGS. 2 and 3. The rucksack frame 13 comprises a first, upper, transverse connecting member 131 The first, upper, transverse connecting member 131 extends over a full width of the rucksack bag 11. The first, upper, transverse connecting member 131 is shown to form anchoring points 131*a* for adjustable stabilizing straps 123 connecting the rucksack bag 11 via the rucksack frame 13 to an upper portion of shoulder straps 122 (see FIG. 1) of the carrying system 12, and providing an upper, forward support for the rucksack bag 11. A first transverse frame extension element 132 is connected to a protrusion 131*b* extending from a centre portion of the upper connecting member 131. The first transverse frame extension element 132 is arranged to be accommodated in channels inside the rucksack bag 11 (see FIG. 1). The first transverse frame extension element 132 extends in both directions from the protrusion 131*b*, forming an upper, middle support for the fabric of bag 11 and being arranged to define an upper portion of the carrying pocket 111 (see FIG. 1). In the depicted embodiment the first transverse frame extension element 132 is provided as two parallel rods 132*a* extending from transverse through bores 131*c* in the protrusion 131*b* with free rod ends 132*b* being interconnected by a connector 132*c*. The transverse extent of the first transverse frame extension element 132 is approximately equal to the transverse extent of the upper connecting member 131, both being dimensioned to suit the width of the bag 11 of the carrying device 1. Thus, the first transverse connecting member 131 and the first transverse frame extension element 132 form at one side of the rucksack bag 11 a stable U-shaped upper support 133 for the carrying pocket 111, the upper support being open to one side of the carrying device 1.

A second, lower transverse frame member 134 is connected to the first, upper connecting member 131 by two vertical members 137. The vertical member 137 may be a tubular vertical member 137. A second transverse frame extension element 135 is connected to a protrusion 134*c* extending from the lower connecting member 134. The second transverse frame extension element 135 extends in one direction only from the protrusion 134*c*, being arranged to define a lower portion of the carrying pocket 111 (see FIG. 1). In the depicted embodiment the second transverse frame extension element 135 is provided as two parallel rods 135*a* extending from transverse bores 134*d* in the protrusion 134 with free rod ends 135*b* being interconnected by a connector 135*c*. The one side transverse extent of the second transverse frame extension element 135 is approximately equal to the transverse one side extent of the lower connecting member 134, both being dimensioned to suit the width of the bag 11 of the carrying device 1. Thus, the second transverse connecting member 134 and the second transverse frame extension element 135 form at one side of the rucksack bag 11 a stable U-shaped lower support 136 for the carrying pocket 111, the lower support 136 being open to one side of the carrying device 1. In the depicted embodiment the protrusion 134*c* is extending off-set a centre portion of the lower connecting member 134, thus allowing cross section of the carrying pocket 111 to extend from top to bottom, thus providing sufficient space for the wide end of a gunstock (not shown) and offer an upper, narrower and sufficiently stable support for a barrel (not shown) of a weapon to be supported without superfluous play.

The second, lower transverse frame member 134 is provided with a first anchoring point 134*a* for an adjustable load transfer strap 124 (see FIG. 1) extending to a central portion 121 of the carrying system 12, arranged for transfer of load from the rucksack bag 11 via the rucksack frame 13 to shoulder straps 122 of the carrying system 12. In an embodiment (not shown) a lower portion of the load transfer strap 124 is provided with several transverse pockets arranged to receive a locking piece (not shown) for height adjustment of the carrying system relative the rucksack frame 13 and thereby the rucksack bag 11. In a preferred embodiment the pocket of the load transfer strap 124 holding the locking piece is accommodated in a recess at a bottom portion of said first anchoring point 134*a*.

The second transverse connecting member 134 is also provided with several second anchoring points 134*b* for shoulder straps 122 arranged for connecting the rucksack frame 13, and thereby the rucksack bag 11, to the carrying system 12, providing adequate adjustment features.

Channels 113 (see FIG. 1) or closable flaps (not shown) are provided in the rucksack bag 11 and are arranged to partly or fully accommodate at least one or more transverse com-ponents of the rucksack frame 13, i.e. the transverse frame extension elements 132, 135 and possibly the connecting members 131, 134, possibly also the vertical members 137. Fabric clamp members 138 (see FIG. 3) are provided to secure the flaps (not shown) to the rucksack frame 13, in FIG. 3 depicted only one fabric clamp member 138 connecta-ble to the first transverse connecting member 131 by screws 138*a*.

Portions of the carrying system 12, e.g. portions of the central portion 121 facing the rucksack bag 11 and the vertical members 137 of the rucksack frame 13 is provided with several second channels 114 (for clarity reasons only one shown in FIG. 1) arranged to receive respective vertical members 137, providing slidable connections between the vertical members 137 and the shoulder straps 122 via the central portion 121.

The connections of the items forming the rucksack frame 13 is secured by fixing means (not shown), preferably in the form of glue or screws, see FIG. 3.

In one embodiment the protrusions 131*b*, 134*c* of the connecting members 131, 134 are provided with countersunk openings 131*d*, 134*e* facing the carrying system 12, arranged for insertion of fixing means in fixing portions of the transverse frame extension elements 132, 135.

Suitable openings (not shown) are provided in the fabrics of the rucksack bag 11 for the insertion of said fixing means during the assembly of the carrying device 1. Furthermore, openings (not shown) in the fabrics of the rucksack bag 11 required to connect straps 122, 123, 124 of the carrying system 12 to any anchoring points 131*a*, 134*b* of the transverse connecting members 134 covered by said fabrics are also provided.

A pocket flap 112 (see FIG. 1) is provided to cover the side opening of the carrying pocket 111. A remotely operated locking device 14 is provided (see FIG. 1), preferably operatable by the carrier of the carrying device by a releasing device 141 located at one of the shoulder straps 122.

The rucksack frame 13 of the carrying device 1 according to the invention improves the stability of the carrying pocket 111 by the upper and lower portion of the carrying pocket 111 being provided with lateral support by the U-shaped portions of the rucksack frame 13. Furthermore, load impacting the rucksack bag 11 causes less deformation of said rucksack bag 11 due to the stabilizing effect of fabrics being attached to the upper transverse frame extension element 132.

Preferably, the upper and lower transverse connecting members 131, 134 are made of a lightweight moulded material like fibre reinforced plastic.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A carrying device for an elongated object, the carrying device comprising a rucksack bag, a rucksack frame, and a carrying system connected to the rucksack frame, and a carrying pocket arranged at one side of the rucksack bag, openable to a lateral exterior of the rucksack bag and arranged to receive at least a portion of the elongated object to be carried, wherein the rucksack frame is integrated in the rucksack bag, the rucksack frame comprising:

a first, upper transverse connecting member; and a first transverse frame extension element accommodated inside the rucksack bag and connected to the first, upper transverse connecting member at a distance therefrom, forming at one lateral side of the rucksack bag a U-shaped upper support for the carrying pocket, the U-shaped upper support being open to one side of the carrying pocket, and the first transverse frame extension element extending in opposing directions, forming an upper support extending a full width of the rucksack bag.

2. The carrying device according to claim 1, wherein the rucksack frame comprises a second, lower transverse connecting member forming a first anchoring point for an adjustable load transfer strap extending to a central portion of the carrying system, arranged for transfer of load from the rucksack bag to shoulder straps of the carrying system.

3. The carrying device according to claim 1, wherein the first, upper transverse connecting member forms anchoring points for adjustable stabilizing straps between the rucksack bag and the carrying system.

4. The carrying device according to claim 1, wherein the rucksack frame is fully or partly accommodated in channels formed in fabrics of the rucksack bag.

5. The carrying device according to claim 1, wherein the first transverse frame extension element extending in opposing directions from a protrusion in the first, upper transverse connecting member.

6. The carrying device according to claim 5, wherein each protrusion is provided with a countersunk opening facing the carrying system and arranged for insertion of fixing means in transverse frame extension element fixing portions.

7. The carrying device according to claim 5, wherein the protrusion is extending from the first, upper transverse connecting member along a center plane of the rucksack bag.

8. The carrying device according to claim 7, wherein the protrusion is provided with a countersunk opening facing the carrying system and arranged for insertion of fixing means in transverse frame extension element fixing portions.

9. The carrying device according to claim 1, wherein the rucksack frame comprises a second, lower transverse connecting member connected to the first, upper transverse connecting member by one or more vertical members, and a second transverse frame extension element is accommodated inside the rucksack bag and connected to the second, lower tranverse connecting member at a distance therefrom, forming a U-shaped lower support for the carrying pocket, the U-shaped lower support being open to one side of the carrying pocket.

10. The carrying device according to claim 9, wherein the second transverse frame extension element extending in one direction only from a protrusion in the second, lower transverse connecting member towards the carrying pocket.

11. The carrying device according to claim 10, wherein the protrusion is provided with a countersunk opening facing the carrying system and arranged for insertion of fixing means in transverse frame extension element fixing portions.

12. The carrying device according to claim 10, wherein the protrusion extends off-set a center plane of the rucksack bag.

13. The carrying device according to claim 12, wherein the protrusion is provided with a countersunk opening facing the carrying system and arranged for insertion of fixing means in transverse frame extension element fixing portions.

* * * * *